US006477949B2

(12) United States Patent
Metrope

(10) Patent No.: US 6,477,949 B2
(45) Date of Patent: Nov. 12, 2002

(54) DEVICE FOR INFEEDING A MATERIAL WEB INTO A ROTARY PRINTING MACHINE

(75) Inventor: Jaques Metrope, Laigneville (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/761,813

(22) Filed: Jan. 16, 2001

(65) Prior Publication Data

US 2001/0008102 A1 Jul. 19, 2001

(30) Foreign Application Priority Data

Jan. 14, 2000 (DE) ..... 100 01 342
Nov. 17, 2000 (FR) ..... 00 14860

(51) Int. Cl.[7] ..... B65H 23/18; B41F 13/03
(52) U.S. Cl. ..... 101/228; 226/92
(58) Field of Search ..... 226/91, 92; 101/228

(56) References Cited

U.S. PATENT DOCUMENTS 4,370,927 A 2/1983 Fischer ..... 101/228
4,409,777 A * 10/1983 White et al. ..... 226/92
4,706,862 A * 11/1987 Theilacker ..... 101/228
4,987,830 A * 1/1991 Fukuda et al. ..... 101/228
5,052,295 A 10/1991 Suzuki et al. ..... 101/227
5,307,970 A * 5/1994 Shibuya et al. ..... 101/228
5,702,043 A 12/1997 Logtens et al. ..... 226/92
5,967,036 A * 10/1999 Marmin et al. ..... 101/219

FOREIGN PATENT DOCUMENTS

DE 198 02 194 A1 10/1998
EP 0 038 450 B1 10/1981
EP 0 418 903 A2 3/1991
EP 0 613 776 B1 9/1994
EP 0 753 406 A1 1/1997

OTHER PUBLICATIONS

Abstract of Japanese Patent No. 2265848AA (Suzuki et al.), dated Oct. 30, 1990.

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A device for infeeding a material web along an infeed path into a rotary printing machine includes drive stations arranged along the infeed path, and an infeed element partially enclosed by a guide formed with a lateral opening at which a material web is fastenable on an extension piece. The infeed device further includes a profiling provided on the infeed element for stiffening the infeed element in an advancement direction along the infeed path. A rotary printing press is provided with the infeed device; and a newspaper rotary printing press is similarly provided.

14 Claims, 3 Drawing Sheets

Fig.5.1
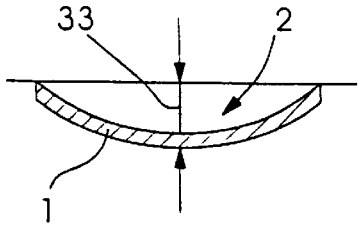
Fig.5.6
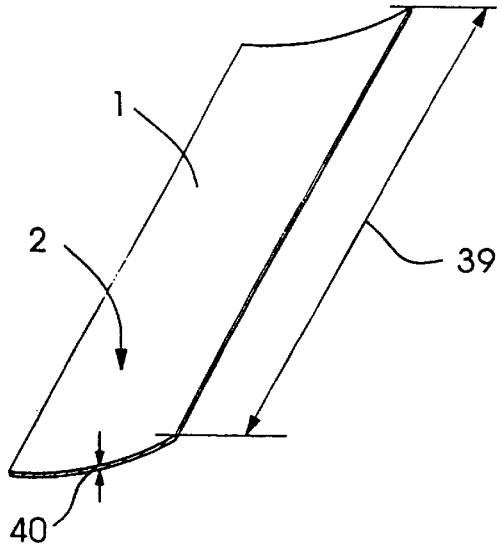
Fig.5.2
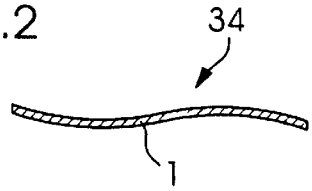
Fig.5
Fig.5.3
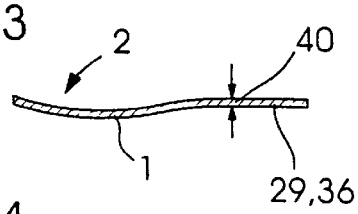
Fig.5.4
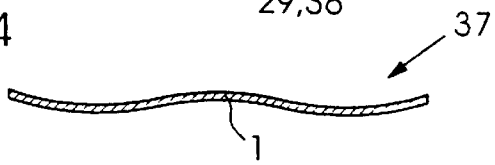
Fig.5.5
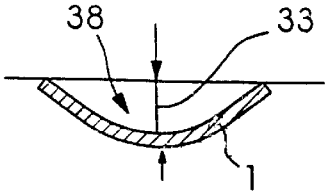

DEVICE FOR INFEEDING A MATERIAL WEB INTO A ROTARY PRINTING MACHINE

BACKGROUND OF THE INVENTION

Field of the Invention

The invention relates to a device for infeeding a material web into a rotary printing machine, by which the material web is introducible from a reel changer through at least one printing unit and through a dryer and a chill-roller group, into various conveying paths through an angle-bar superstructure.

The published European Patent Document EP 0 038 450 B1 is concerned with an infeed device for web-fed rotary printing machines. The infeed device includes an infeed element formed of a flexible solid material which is displaceable along a tubular guide laterally of an infeeding route for the material web. The infeed element has a solid round or polygonal cross section, so that there is an almost equal bending resistance in all directions transverse to the longitudinal axis of the infeed element. The infeed element is guided in a tubular guide formed with a slit, and has a pulling hook projecting laterally out of the slit formed in the guide. The infeed element is driven by one or more driven friction-wheel pairs. Due to the solid polygonal or round cross section, the infeed device according to the aforementioned published European patent document requires a relatively large amount of space as it passes through the individual printing units.

The published European Patent Document EP 0 613 776 B1 is concerned with a profile bar for guiding a roller chain. The profile bar has an approximately C-shaped profile with a base member and two mutually parallel legs extending perpendicularly to the base member and, respectively, formed with a longitudinal groove or slot for accommodating therein and for guiding a roller chain movable in the profile bar and serving for drawing paper into a web-fed rotary printing machine. One of the legs is formed with openings extending through the leg and being spaced apart from one another in the travel direction of the roller chain. The openings are formed as slits passing through the entire length of the leg, which extends at right angles from the base member. The roller chain takes up a given minimum overall height, likewise, due to which the installation space, which is, in any case, rather tight in the printing unit, is additionally restricted.

The published German Patent Document DE 198 02 194 A1 relates to a web-infeed device for a rotary printing machine. The length of a flexible, open-ended infeed element is somewhat greater than the distance between the spaced-apart drive units. Of these, a number are provided for moving the infeed element in guides and diverters along the infeed route. Switches for switching the respectively required drive element on, and for simultaneously switching off the drive element no longer required, are provided along the infeed route, the switches being actuatable by the infeed element, which is provided with a coating for reducing the friction in the guide.

In this web-infeed device, a multiplicity of additional components, such as balls, for example, are required which are positionable in cages, rings or cutouts in the infeed element which are adapted to or matched with other geometries, thus constituting additional outlay or expense.

The published Japanese Document Hei 2-265 848 is concerned with a device for infeeding the paper for a rotary printing machine. In this construction, the web which is to be introduced is guided from a paper-reel mounting, via a printing unit, up to a folder. A guide path is formed along the web path predetermined by the machine components. An infeed element for introducing the paper web is of tape-shaped construction and is formed with regularly arranged recesses and elevations on at least one side. It is also possible for openings to pass right through the tape-shaped infeed element. Also provided on the tape-shaped infeed element is a take-up section for the start of the material web, which is to be fastened and threaded in. A drive system formed of a multiplicity of drive stations engages in the openings or recesses, or the elevations of the tape-shaped infeed element in order to guide the latter through the rotary printing machine.

SUMMARY OF THE INVENTION

In view of the aforedescribed prior state of the art, it is an object of the invention to provide a device for infeeding a material web into a rotary printing machine, wherein the operational reliability of the improved infeed device is increased, buckling resistance of the infeed device is improved, and the number of conveying elements and drive elements, respectively, such as balls, for example, are reduced.

With the foregoing and other objects in view, there is provided in accordance with one aspect of the invention, a a device for infeeding a material web along an infeed path into a rotary printing machine, including drive stations arranged along the infeed path, and an infeed element partially enclosed by a guide formed with a lateral opening at which a material web is fastenable on an extension piece, comprising a profiling provided on the infeed element for stiffening the infeed element in an advancement direction along the infeed path.

In accordance with another feature of the invention, the drive stations, respectively, include drive rollers, respectively, formed with a cylindrical jacket surface.

In accordance with a further feature of the invention, the drive stations, respectively, include drive rollers having jacket surfaces, respectively, matching with or adjusted to the profiling of the infeed element.

In accordance with an added feature of the invention, the jacket surfaces of respective pairs of the drive rollers of the drive stations are respectively convexly and concavely curved.

In accordance with an additional feature of the invention, the infeed element is convexly/concavely curved perpendicularly to the advancement direction thereof along the infeed path.

In accordance with yet another feature of the invention, the infeed element has a wave-shaped profile.

In accordance with yet a further feature of the invention, the profiled infeed element has an adjoining planar extension.

In accordance with yet an added feature of the invention, the infeed element is formed with a U-shaped profile having a given depth of curvature.

In accordance with yet an additional feature of the invention, the guide enclosing the infeed element is formed complementarily to the infeed element.

In accordance with still another feature of the invention, the infeed element merges, from a profiling upline from a deflection, into a planar-abutment position and, from the latter, rapidly resumes a profiling downline from the deflection.

In accordance with still a further feature of the invention, the drive rollers are formed of yieldable material adaptable to the profiling.

In accordance with still an added feature of the invention, the infeed element is formed of spring steel.

In accordance with still an additional feature of the invention, during passage of the infeed element through a drive station with cylindrical drive rollers, the profiling of the infeed element fades away from the infeed element in an engagement region and, after passage through the drive station, is restored to the infeed element.

In accordance with another aspect of the invention, there is provided a rotary printing machine with a device for infeeding a material web along an infeed path into the rotary printing machine, including drive stations arranged along the infeed path, and an infeed element partially enclosed by a guide formed with a lateral opening at which a material web is fastenable on an extension piece, comprising a profiling provided on the infeed element for stiffening the infeed element in an advancement direction along the infeed path.

In accordance with a concomitant aspect of the invention, there is provided a newspaper rotary printing machine with a device for infeeding a material web along an infeed path into the rotary printing machine, including drive stations arranged along the infeed path, and an infeed element partially enclosed by a guide formed with a lateral opening at which a material web is fastenable on an extension piece, comprising a profiling provided on the infeed element for stiffening the infeed element in an advancement direction along the infeed path.

The advantages of the construction according to the invention can be seen in that profiling the infeed element relative to the advancement direction thereof can increase the buckling resistance thereof to a considerable extent, with the result that it is possible to dispense with the integration of conveying and drive elements, such as balls, for example, in the infeed element. The profiling may be impressed on the material of the infeed element over rectilinearly extending passages of the infeed path; during passage through 90° deflections or 180° deflections, the profile is forced out of the infeed element, and is then reestablished therein after the infeed element has passed the deflecting element. The individual drive stations by which the infeed element is conveyed through the rotary printing machine may be arranged farther apart from one another because, due to the profiling, there is a drastic reduction in the friction of the infeed element in the guide enclosing it.

In an advantageous configuration of the concept upon which the invention is based, the infeed element is driven via a drive station which includes drive rollers having a cylindrical jacket surface. The jacket surfaces grip the profiled infeed element and smooth the latter in the engagement region until, following the passage of the infeed element through the drive nip between the two drive rollers, the infeed element resumes the originally profiled shape thereof. Instead of drive stations with drive rollers having cylindrical jacket surfaces, it is also possible to provide drive rollers of which the jacket surfaces correspond to the profiling of the infeed element. The drive rollers may have, for example, a convexly/concavely curved jacket surface, the infeed element being conveyed between the drive rollers and through the nip therebetween by friction.

The profiling of the infeed element may extend in wave-shaped form, in order to increase buckling resistance; on the other hand, the profiling of the infeed element may comprise a straightforward circular segment-shaped curvature which is adjoined by a planar extension projecting from the lateral opening of the guide. The infeed element may also have an approximately U-shaped profile, with a somewhat more pronounced curvature relative to the center of curvature.

The guide which encloses the profiled infeed element for material webs is formed complementarily to the contour of the infeed element, thereby making it possible to achieve particularly low-friction guidance along the advancement path of the infeed element.

For pronounced deflections, for example a 90° deflection or 180° deflection, the profiling of the infeed element merges, as the infeed element abuts the jacket or lateral surface of a deflecting roller, into a planar-abutment position of the infeed element against the lateral surface, before the infeed element regains the profiling thereof after the infeed element has passed the deflection. The drive rollers or the deflecting rollers for the infeed element are preferably formed of a yieldable or pliant material which adapts to the profiling of the infeed element. The infeed element by itself is preferably formed, for example, of extremely thin spring steel material, which allows the profiling to fade away briefly from the infeed element, but subsequently resumes the profiling. This is particularly advantageous when the infeed element runs through pronounced deflections of 90° or 180°.

The construction proposed in accordance with the invention can be particularly advantageous in jobbing presses or newspaper presses wherein a multiplicity of different web paths have to be realized in the angle-bar superstructure in order to put together a great variety of copies.

Other features which are considered as characteristic for the invention are set forth in the appended claims.

Although the invention is illustrated and described herein as embodied in a device for infeeding a material web into a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 5.1 to 5.5 are cross-sectional views of spring-steel infeed elements for material webs, which have respectively different profiling geometries; and FIG. 5.6 is a fragmentary, front, right side and top perspective view of another infeed element with a different profiling geometry.

DESCRIPTION OF THE PREFERRED EMBODIMENTS

Figure 1:
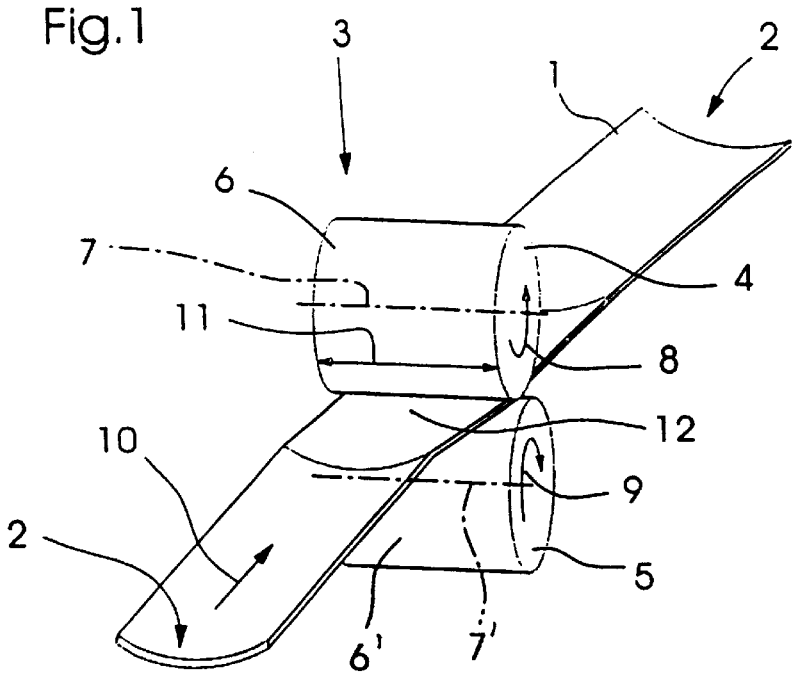
FIG. 1 is a front, right side and top perspective view of a drive station with drive rollers having cylindrical jacket surfaces for an infeed element.

Referring now to the drawings and, first, particularly to FIG. 1 thereof, there is shown therein a drive station with drive rollers having a cylindrical jacket surface for an infeed element 1. The infeed element 1, preferably formed of thin spring steel, is provided with a profiling 2 which, in the exemplary embodiment illustrated in FIG. 1, is formed with a cylindrical curvature in the infeed element, extending in the advancement direction 10 of the latter. This increases the buckling resistance of the infeed element 1 to a considerable extent; furthermore, the infeed element 1 can be conveyed more easily through a guide (not shown in FIG. 1) which encloses it. The profiled infeed element 1 may be driven by a drive station 3, of which drive rollers 4 and 5 rotate about respective axes of rotation 7 and 7' and are formed with respective cylindrical jacket surfaces 6 and 6'. The upper drive roller 4 rotates in a rotary direction represented by the arrow 8, while the lower drive roller 5 rotates in a rotary direction represented by the arrow 9.

Due to the rectilinearly extending drive nip between the drive rollers 4 and 5 of the drive station 3, the profiling 2 is forced or pressed out of the infeed element, within the engagement region 12 of the infeed element 1, before the profiling 2 is reestablished in the infeed element 1 after the latter has passed through the rectilinear drive nip between the drive rollers 4 and 5.

The width 11 by which the drive rollers 4 and 5 overlap the infeed element 1 corresponds approximately to the width of the infeed element 1.

Figure 2:
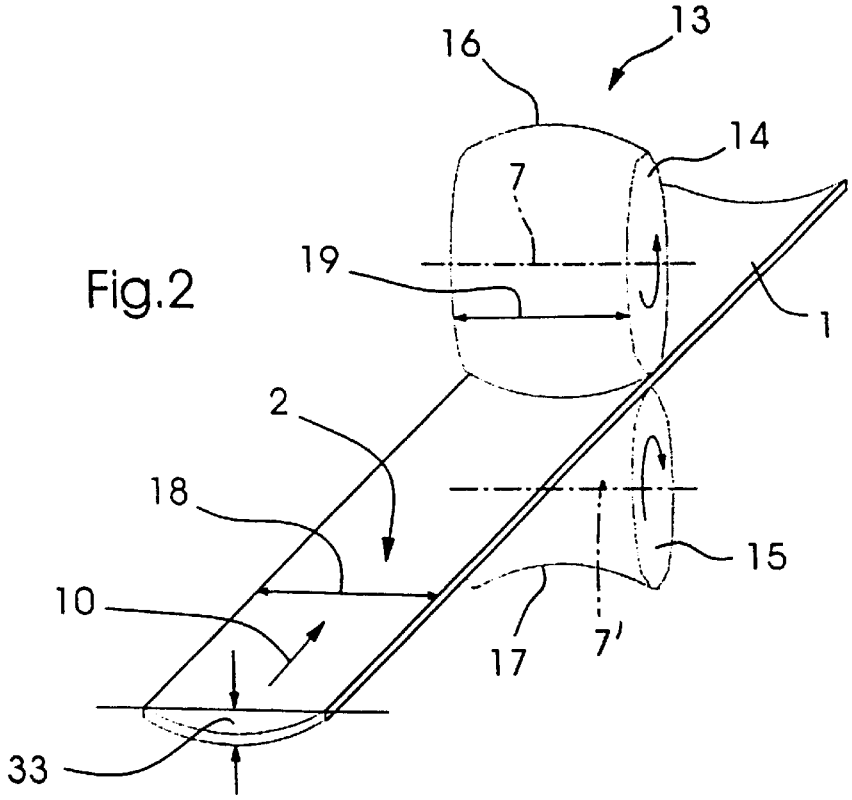
FIG. 2 is a slightly enlarged view like that of FIG. 1 of another embodiment of the drive station wherein the drive rollers are profiled in accordance with a profiling of the infeed element.

FIG. 2 shows a drive station 13 with drive rollers 14 and 15 profiled in accordance with the profiling of the infeed element 1. The drive rollers 14 and 15 of the drive station 13, have a convex and concave jacket surface 16 and 17, respectively, adapted to or matched with the respective profiling 2 of the infeed element 1. If the drive rollers 14 and 15 are, in contrast, produced from soft, yieldable or pliant material, the jacket surfaces of the drive rollers 14 and 15 assume the respective profiling 2 of the infeed element 1. In the configuration according to FIG. 2, the corresponding contours of the drive roller 14 and the drive roller 15, on the one hand, with the infeed element 1, on the other hand, do not result in any widening of the infeed element 1 in the engagement region of the drive rollers 14 and 15. The width 19 of the drive rollers 14 and 15 corresponds to the width 18 of the infeed element 1. Shown in FIG. 2 is the depth of curvature 33 measured between the associated arrows, by which the lowest point of the profiling 2 is spaced away from the lateral edges of the infeed element 1. It is possible for the two drive rollers 14 and 15, respectively, of the drive station 13 either to have a drive or to be connected to one another via a gearwheel connection or the like.

Figure 3:
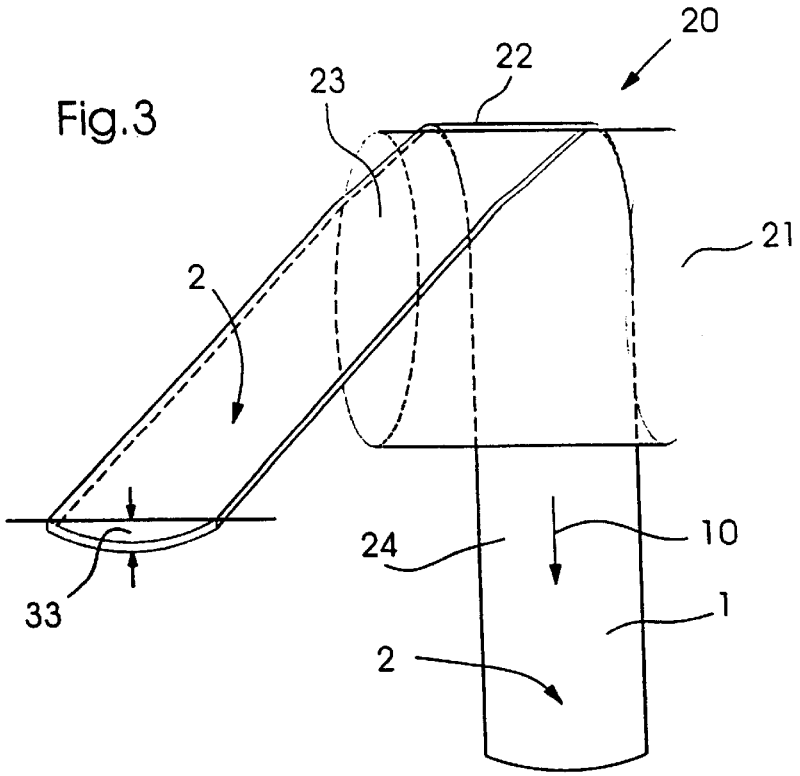
FIG. 3 is a front, right side and top perspective view of a deflecting roller which deflects an infeed element in an open 90° deflection.

FIG. 3 shows a deflecting roller 21 about which an infeed element 1 according to the invention is deflected in an open 90° deflection 20. The infeed element 1, onto which a non-illustrated material web is fastenable, is provided with a profiling 2 having the depth of curvature 33 as characteristic measurement. The infeed element 1 is formed of a thin spring steel and maintains the profiling 23 thereof until that point in time at which it runs onto the surface of the deflecting roller 21 effecting the 90° deflection 20. The profiling 2, 23 fades away from the spring-steel infeed element 1 at the instant of time that the latter runs into a planar-abutment position 22 on the jacket surface of the deflecting roller 21. The profiling 2 is reestablished following passage of the jacket surface of the deflecting roller 21, as represented by 24.

Figure 4:
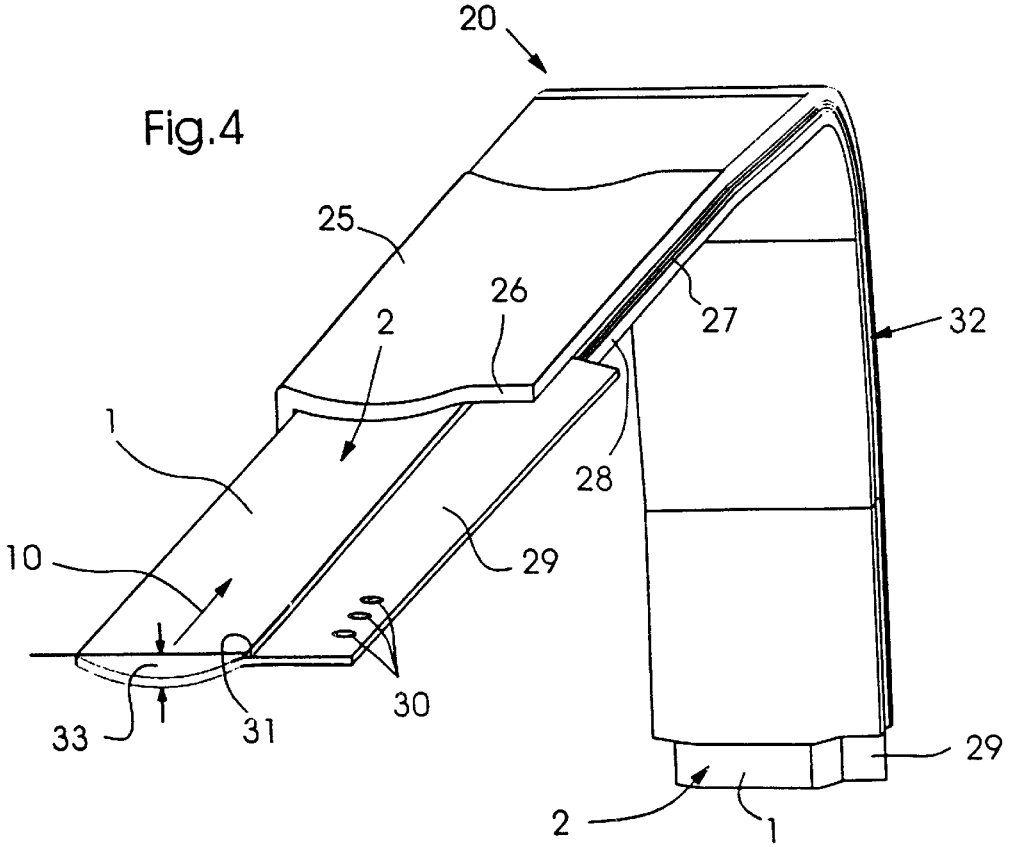
FIG. 4 is a front, right side and top perspective view of a guide wherein an infeed element is virtually enclosed in a 90° deflection.

FIG. 4 shows a 90° deflection 20 of the infeed element 1 on a guide 25 which virtually encloses the infeed element 1. The guide 25, which nearly completely encloses the infeed element 1, likewise describes a 90° deflection 20. The guide 25 includes an upper leg 26 and a lower leg 28, as viewed in FIG. 4, defining therebetween an opening 27 out of which an extension piece or lug 29 of the infeed element 1 extends. Formed in the extension lug 29 are a plurality of bores 30, whereon a non-illustrated starting end of a material web which is to be threaded into the components of the rotary printing machine is hung. In the embodiment illustrated in FIG. 4, the infeed element 1, which is preferably produced from thin spring steel material, is provided with a profiling 2 and, analogously to the infeed element 1 according to FIGS. 2 and 3, has a depth of curvature 33.

The legs 26 and 28 of the guide 25, which encloses the infeed element 1, are formed with a contour complementing the profiling 2 of the infeed element 1. The 90° deflection 20 is not formed on a jacket surface of a deflecting roller that is moved by the infeed element 1 as it passes thereover, but is rather formed by fixed legs 26 and 28 of the guide 25.

A guide slit 32 constituting the aforementioned opening 27 formed between or defined by the two legs 26 and 27 of the guide 25, accommodates the extension piece or lug 29 whereon a material web is to be hung, the extension piece or lug 29 being connected to the infeed element 1 via a transition region 31.

FIGS. 5.1 to 5.6 show profiling geometries of preferably spring-steel infeed elements for material webs.

FIG. 5.1 shows the profiling of the web infeed element according to FIGS. 1, 2 and 3. The preferably spring-steel web infeed element 1 is provided with a profiling 2 which is characterized by a depth of curvature 33.

FIG. 5.2 shows a double profile 34 of a wave-form profiling in the web infeed element 1, while the web infeed element 1 according to FIG. 4 is illustrated in FIG. 5.3. The profiled region 2 and the planar extension 29, 36 have a material thickness 40 of only a few tenths of a millimeter.

FIG. 5.4 shows a web infeed element 1 which is profiled in the form of a double wave 37 and is of greater width than the preceding web infeed elements 1.

FIG. 5.5 shows a web infeed element 1 having a profiling which is similar to the profiling 2 according to FIG. 5.1 but has a depth of curvature 33 which is of greater dimension, and tends to approach a U-shape 38.

FIG. 5.6 shows a web infeed element 1 which is provided with a profiling 2 and is formed of spring steel material having a thickness 40, the profiling 2 extending over the length 39 of the infeed element 1.

Provided along the infeed path of material webs in jobbing presses or newspaper rotary presses are a plurality of drive stations 3 and 13, respectively, and diverters for setting different conveying paths for the inwardly threaded material webs. The drive stations 3 and 13 according to FIGS. 1 and 2, respectively, may be provided with pairs of mutually cooperating drive rollers 4, 5 and 14, 15, respectively, which are advantageously formed of yieldable or pliant material matching with or adapted to the profiling of the respective web infeed element 1. By providing diverters in the infeed path for the material web, it is possible to set different infeed paths for the material webs in the angle-bar superstructure of a jobbing press or newspaper rotary press, with the result that, depending upon the copy format which is to be produced and the number of copy layers which are to be brought together, it is possible to preset automatically infeed paths which can be adapted to or matched with different individual production requirements.

I claim:

1. A device for infeeding a material web along an infeed path into a rotary printing machine, comprising:

drive stations arranged along the infeed path;

a guide formed with a lateral opening for fastening the material web on an extension piece at said opening; and an infeed element partially enclosed by said guide, said infeed element including a profiling having a concave curvature on at least one section of one side of said infeed element and a convex curvature on a corresponding section on another side of said infeed element for stiffening the infeed element in an advancement direction along the infeed path.

2. The device according to claim 1, wherein the drive stations, respectively, include drive rollers, respectively, formed with a cylindrical jacket surface.

3. The device according to claim 2, wherein the drive rollers are formed of yieldable material adaptable to said profiling.

4. The device according to claim 2, wherein a nip is formed between the drive rollers of a drive Station and, during passage of the infeed element through said nip, said profiling of the infeed element fades away from the infeed element in an engagement region of the drive rollers and, after passage through the drive station, is restored to the infeed element.

5. The device according to claim 1, wherein the drive stations, respectively, include drive rollers having jacket surfaces, respectively, matching said profiling of the infeed element.

6. The device according to claim 5, wherein said jacket surfaces of the drive rollers of the drive stations are convexly and concavely curved corresponding to said sections.

7. The device according to claim 1, wherein the infeed element has a wave-shaped profile.

8. The device according to claim 1, wherein the profiled infeed element has an adjoining planar extension.

9. The device according to claim 1, wherein the infeed element is formed with a U-shaped profile having a given depth of curvature.

10. The device according to claim 1, wherein the guide enclosing the infeed element is formed complementarily to the infeed element.

11. The device according to claim 1, further comprising a defection roller with a defection element, said infeed element turning, from said profiling upline in the advancement direction from said deflection element, into a planar layout and, from the latter, rapidly resuming said profiling downline in the advancement direction from said deflection element.

12. The device according to claim 1, wherein the infeed element is formed of spring steel.

13. A rotary printing machine with a device for infeeding a material web along an infeed path into the rotary printing machine, the device comprising:

drive stations arranged along the infeed path;

a guide formed with a lateral opening for fastening the material web on an extension piece at said opening; and an infeed element partially enclosed by said guide, said infeed element including a profiling having a concave curvature on at least one section of one side of said infeed element and a convex curvature on a corresponding section on another side of said infeed element for stiffening the infeed element in an advancement direction along the infeed path.

14. A newspaper rotary printing machine with a device for infeeding a material web along an infeed path into the rotary printing machine, the device comprising:

drive stations arranged along the infeed path;

a guide formed with a lateral opening for fastening the material web on an extension piece at said opening; and an infeed element partially enclosed by said guide, said infeed element including a profiling having a concave curvature on at least one section of one side of said infeed element and a convex curvature on a corresponding section on another side of said infeed element for stiffening the infeed element in an advancement direction along the infeed path.

* * * * *